US006565342B1

(12) United States Patent
Chow

(10) Patent No.: US 6,565,342 B1
(45) Date of Patent: May 20, 2003

(54) APPARATUS FOR MAKING PRECISION METAL SPHERES

(75) Inventor: Hubert K. Chow, Taiwan (TW)

(73) Assignee: Accurus Scientific Co. Ltd. (TW)

( * ) Notice: Subject to any disclaimer, the term of this patent is extended or adjusted under 35 U.S.C. 154(b) by 0 days.

(21) Appl. No.: 09/714,794

(22) Filed: Nov. 17, 2000

(51) Int. Cl.[7] ..... B28B 9/08

(52) U.S. Cl. ..... 425/6; 425/DIG. 20; 264/9; 264/12

(58) Field of Search ..... 425/DIG. 20, 72.1, 425/6, 7; 264/9, 12; 75/335, 337, 338, 339, 340

(56) References Cited

U.S. PATENT DOCUMENTS

| | | | | | |
|---|---|---|---|---|---|
| 3,579,721 | A | | 5/1971 | Kaltenbach | 425/3 |
| 3,607,169 | A | | 9/1971 | Coxe | 65/21.4 |
| 3,765,853 | A | | 10/1973 | Riebling | 65/21.3 |
| 3,771,929 | A | * | 11/1973 | Hellman et al. | 425/7 |
| 3,817,502 | A | | 6/1974 | Taylor | 266/90 |
| 3,826,598 | A | | 7/1974 | Kaufmann | 425/7 |
| 4,035,116 | A | * | 7/1977 | O'Brien et al. | 148/540 |
| 4,097,266 | A | | 6/1978 | Takahashi et al. | 428/570 |
| 4,162,282 | A | | 7/1979 | Fulwyler et al. | 264/9 |
| 4,179,278 | A | | 12/1979 | Beggs et al. | 75/10.38 |
| 4,181,522 | A | | 1/1980 | Galey et al. | 75/709 |
| 4,216,178 | A | | 8/1980 | Anderson | 264/9 |
| 4,237,695 | A | | 12/1980 | Oberpriller et al. | 62/63 |
| 4,264,641 | A | | 4/1981 | Mahoney et al. | 427/483 |
| 4,302,166 | A | | 11/1981 | Fulwyler et al. | 425/6 |
| 4,346,387 | A | | 8/1982 | Hertz | 347/75 |
| 4,385,013 | A | | 5/1983 | Couling et al. | 164/130 |
| 4,428,894 | A | * | 1/1984 | Bienvenu | 75/335 |
| 4,463,359 | A | | 7/1984 | Ayata et al. | 347/56 |
| 4,469,313 | A | * | 9/1984 | Ichidate et al. | 266/207 |
| 4,580,616 | A | | 4/1986 | Watts | 164/57 |
| 4,705,656 | A | | 11/1987 | Onoyama et al. | 751/333 |
| 4,795,330 | A | | 1/1989 | Noakes et al. | 425/6 |
| 4,929,400 | A | | 5/1990 | Rembaum et al. | 264/10 |
| 5,136,515 | A | | 8/1992 | Helinski | 700/119 |
| 5,171,360 | A | | 12/1992 | Orme et al. | 164/46 |
| 5,191,929 | A | | 3/1993 | Kubota et al. | 164/500 |
| 5,226,098 | A | | 7/1993 | Hirosawa | 328/180 |
| 5,226,948 | A | | 7/1993 | Orme et al. | 75/331 |
| 5,229,016 | A | | 7/1993 | Hayes et al. | 222/590 |
| 5,250,103 | A | | 10/1993 | Yamauchi et al. | 75/584 |
| 5,261,611 | A | | 11/1993 | Huxford | 239/690 |
| 5,266,098 | A | | 11/1993 | Chun et al. | 75/335 |
| 5,285,934 | A | | 2/1994 | Yamauchi et al. | 222/595 |
| 5,321,583 | A | | 6/1994 | McMahon | 361/770 |
| 5,411,602 | A | | 5/1995 | Hayes | 148/23 |
| 5,520,371 | A | | 5/1996 | Miller et al. | 266/100 |

(List continued on next page.)

FOREIGN PATENT DOCUMENTS

SU 1682039 A1 10/1991

OTHER PUBLICATIONS

Shortley et al; Elements of Physics; Textbook; 1953; Prentice Hall, Inc.; New Jersey; pp 140 and 141.

Swanson; Fluid Mechanics; Textbook; 1970; Holt Binehart & Winston, Inc.; New York; pp 78 and 79.

*Primary Examiner*—Jan H. Silbaugh
*Assistant Examiner*—Joseph S Del Sole
(74) *Attorney, Agent, or Firm*—IP Strategies P.C.

(57) ABSTRACT

An apparatus for forming metal spheres includes a droplet generator, a buffering chamber, and a cooling drum. The droplet generator generates a droplet from a molten metal mass. The buffering chamber receives the droplet from the droplet generator, and diminishes internal kinetic energy of the droplet without solidifying the droplet. The cooling drum receives the droplet from the buffering chamber, and cools the droplet to the extent that the droplet solidifies into a metal sphere. The apparatus can further include a collector arrangement that receives the metal spheres from the cooling drum and makes the metal spheres available for collection.

67 Claims, 12 Drawing Sheets

U.S. PATENT DOCUMENTS

| | | | | |
|---|---|---|---|---|
| 5,520,715 | A | 5/1996 | Oeftering | 75/335 |
| 5,550,044 | A | 8/1996 | Kosak et al. | 435/177 |
| 5,560,543 | A | 10/1996 | Smith et al. | 239/102.2 |
| 5,736,200 | A | 4/1998 | Beardsley et al. | 427/450 |
| 5,761,779 | A | 6/1998 | Maruyama et al. | 29/899 |
| 5,810,988 | A | 9/1998 | Smith, Jr. | 204/666 |
| 5,891,212 | A | 4/1999 | Tang et al. | 73/335 |
| 5,935,406 | A | 8/1999 | Hajmrle et al. | 205/149 |
| 5,938,102 | A | 8/1999 | Muntz et al. | 228/102 |
| 5,993,509 | A | 11/1999 | Tsao et al. | 75/337 |
| 6,029,909 | A | 2/2000 | Smith | 239/318 |
| 6,083,454 | A | 7/2000 | Tang et al. | 266/262 |
| 6,202,734 | B1 | 3/2001 | Sackinger et al. | 164/271 |
| 6,230,786 | B1 | 5/2001 | Choshi | 164/312 |

* cited by examiner

APPARATUS FOR MAKING PRECISION METAL SPHERES

FIELD OF THE INVENTION

The present invention relates to methods of making metal spheres. In particular, the present invention relates to making metal spheres from molten metal, such that the solid metal spheres achieve a very close tolerance for sphericity and size. Such metal spheres, particularly precision miniature metal spheres, have many industrial applications. For example, such spheres may be used to form Ball Grid Array (BGA) and Flip Chip (FC) arrangements in high-density integrated circuit packaging, and are also used as writing tips of ball pens.

BACKGROUND OF THE INVENTION

Conventionally, small precision metal spheres are made using a mechanical process by which a number of small metal particles are cut or punched out from fine wire or sheets. Those particles are then dropped into a tank of hot oil having a temperature that is higher than that of the melting point of the particles. In this hot oil bath, all the metal particles are melted, forming small round droplets due to surface tension of the molten metal. As the temperature of the oil cools down to below the melting point of the metal droplets, the droplets solidify into spheres. This mechanical method has intrinsic limitations that result in coarse dimensional tolerances, because each mechanical operation adds a certain amount of deviation to the size and uniformity of the particles, which together produce an unacceptable cumulative effect. Therefore, spheres are not precisely made according to this process. Further, the resulting spheres must undergo a sophisticated washing process to get rid of the oil and other surface contaminants.

Over the past two decades, many methods have been developed for generating precision molten droplets to improve the dimensional tolerances of the spheres. These new methods commonly utilize a crucible in which to melt the metal, and then cause the molten metal to flow out of the crucible through a small nozzle. Droplets are formed by shaking either the crucible or the nozzle, or by oscillating inlet gas to affect the pressure on the molten metal in the crucible. These types of vibratory disturbances that are used to generate the droplets are typically controlled by some electronic means. Due to the surface tension of the molten metal droplets, they automatically form a spherical shape while passing through a cooling medium after passing through the nozzle. However, the parameters of those processes and the environmental conditions of the electronic droplet generators are critical to the uniformity of the output. In many cases, these processes can only reach a quasi-steady-state, which limits the production throughput as well as the quality of the resulting spheres.

There is therefore a need for a process for forming metal spheres by which tolerances on the size and shape of the spheres can be kept small. Such a process must allow for a reasonable throughput, and processing of the spheres such as by washing and other finishing actions should be kept to a minimum. In order to be truly useful, such a process must relatively simple, requiring few controls of parameters of the process.

SUMMARY OF THE INVENTION

It is therefore an objective of the present invention to provide a process by which precision metal spheres may be formed.

It is a further objective of the present invention to provide a process by which the degree of deviation from a perfect spherical shape of the metal spheres can be minimized.

It is an additional objective of the present invention to provide a process by which the size of the metal spheres can be determined within a small tolerance.

It is also an objective of the present invention to provide a process by which metal spheres are formed such that the metal spheres require less post-formation cleaning than do conventionally-produced metal spheres.

It is another objective of the present invention to provide a process by which fewer parameters must be controlled than when utilizing conventional processes.

It is a further objective of the present invention to provide a process by which throughput of the metal spheres is not hampered by the precision achieved in the finished product.

It is also an objective of the present invention to provide an apparatus that facilitates the process of the present invention.

The present invention is a method of forming metal spheres from molten metal in which precisely-sized droplets of the molten metal are separated from a metal mass to form the metal spheres. The droplets of the molten metal are first projected in an upward direction and buffered prior to descending through a cooling medium. Through the use of inlet gas and liquid, the cooling medium is controlled for precision solidification of the metal spheres. The solid spheres enter a liquid bath in a collection receptacle at the end of the cooling process, where they are automatically collected and separated from the liquid, which is returned to the collection receptacle for reuse.

Instead of disturbing the steady flow of the molten metal stream to create droplets, the method of the present invention utilizes a fast vibratory piston to strike each individual droplet out through a nozzle. Driven in this manner, the droplets can be shot initially upward through a cooling medium and spend more time passing through the medium before solidification of each droplet begins. Thus, a shorter cooling tower can be used, thereby saving costs related to the height of the manufacturing room, as well as reducing the amount of coolant required during the solidification process. As the piston slams a stopper or withdraws its direction of motion quickly, the resulting sudden impact transfers the energy at the piston to the molten metal and creates a droplet that shoots out through the nozzle. Control of the striking force of the piston against the stopper, and knowledge of the size of the aperture in the nozzle, allow droplets of molten metal having precisely-controlled volumes to be separated from the molten metal mass and propelled through the cooling medium, allowing for the formation of spheres of uniform size.

The structure of the apparatus of the present invention includes a buffering chamber that is designed to provide the cooling droplets with enough time to allow the internal energy to settle down before final formation and solidification. The kinetic energy within a molten droplet is usually higher than its surface tension energy right after the droplet changes dynamically in this fashion, and therefore the droplet does not acquire a spherical shape until a large percentage of this internal kinetic energy is released. When the surface tension of a droplet dominates the internal kinetic energy as the molten metal cools, the shape of the droplet becomes spherical automatically. As previously stated, the molten metal droplets are first propelled in an upward direction in the chamber, before being overcome by gravity and allowed to fall back downward. This buffering chamber has a heating system that controls the temperature of the gas inside the chamber to prevent the droplets from solidifying before the shape of the sphere is mature. The gas used is preferably an inert gas such as nitrogen, or a mixture of nitrogen and hydrogen. The temperature inside the chamber is determined empirically, depending on certain properties of the molten droplets. Typically, this temperature falls in the range between 0° C. and 100° C., depending on the size and material of the droplets.

A gas screen gate is disposed beneath the buffering chamber. This gate is a large hollow disc with two openings, one each at the centers of both top and bottom faces of the circular disc. One or more fans are disposed inside the disc along the edge of the disc wall. The fan blows in a direction tangential to the circular wall, causing the gas within the disc to flow in a circular direction within the hollow interior of the disc. This movement creates a gas barrier that slows down the heat exchange rate between the buffer chamber and the top end of the cooling tower, so that the droplets do not experience quick cooling while still in the buffering chamber. The two openings in the gate allow the droplets to pass out of the buffering chamber under the force of gravity.

Below the gas gate, a number of cooling drums are connected in a stack to form a cooling tower. Each drum has two sections formed by coaxial cylinders. The inner section of the drum is a cylinder having an open top and bottom so that the falling droplets can pass through. An outer shell forms a container with the cylindrical wall of the inner section, and is used to hold coolant or other low temperature agent such as liquid nitrogen. There are two small inlet pipes connected to the outer container of the drum. One is used to provide coolant to the outer container, and the other is used to blow a cold agent or low temperature gas around the inner section when rapid cooling is required. There are a number of small openings around the top part of the wall separating the inner section from the outer shell, to relieve pressure on the cylindrical walls and provide a passage for additional inert gas to be provided to the cooling tower.

At the bottom of the cooling tower, there is a funnel shaped collector. The collector has an outer hollow shell that is pumped into vacuum to provide good thermal insulation. The collector is filled with a liquid cooling agent such as Hexane, which has a melting point of about −100° C. The liquid agent also serves to provide a low-impact medium that stops the falling metal spheres. At the termination of the collector, there is a collecting container used to collect the mixture of solidified spheres and cooling liquid. This mixture is pumped up to above the liquid level of the collector and then flows downward into the collecting container, in which is placed a fine mash basket. The container has a pipe at the bottom end to allow the liquid to flow back to the collector after the mesh basket catches the metal spheres. The spheres that are trapped in the mesh basket can then be collected, such as by picking them out through the top opening of the container. The container opening has a gas-tight door, and the feedback pipe has a valve to prevent backflow.

In summary, a method of forming metal spheres according to the present invention includes ejecting a precisely measured droplet of molten metal from a molten metal mass, buffering the molten metal droplet to reduce the internal kinetic energy of the droplet without solidifying the droplet and cooling the buffered droplet until the droplet solidifies in the form of a metal sphere. The method may also include collecting the metal sphere.

Ejecting a droplet of molten metal may include disposing the molten metal mass in a fixed volume, providing an aperture as an outlet to the fixed volume, striking the molten metal mass with an impulse force and allowing the impulse force to propagate through the molten metal mass to cause a droplet of the molten metal mass to be ejected through the aperture. Preferably, the droplet is ejected in a generally upward direction.

Buffering the molten metal droplet may include cooling the droplet to an extent that is less than is necessary to cause the droplet to solidify, and allowing internal kinetic energy of the droplet to diminish. Further, buffering the molten metal droplet may include allowing the ejected droplet to ascend to a maximum height, and then allowing the droplet to descend through a medium having a temperature that is controlled such that the droplet is cooled but not allowed to solidify.

Cooling the buffered droplet may include allowing the droplet to descend through a medium having a temperature that is controlled to cool the droplet.

Collecting the metal sphere may include immersing the metal sphere in a liquid, and separating the metal sphere from the liquid. Separating the metal sphere from the liquid may include depositing the liquid and the metal sphere in a container having drainage holes that are smaller than the metal sphere, and draining the liquid from the container through the drainage holes.

An apparatus for fabricating metal spheres according to the present invention includes a droplet generator that generates a droplet from a molten metal mass, a buffering chamber that receives the droplet from the droplet generator, and diminishes internal kinetic energy of the droplet without solidifying the droplet, and a cooling drum that receives the droplet from the buffering chamber, and cools the droplet to the extent that the droplet solidifies into a metal sphere. The apparatus may further include a collector arrangement that receives the metal spheres from the cooling drum and makes the metal sphere available for collection.

The droplet generator may include a receptacle in which the molten metal mass is contained, wherein the receptacle includes a plurality of walls and a tube, an aperture through a first wall of the plurality of walls of the receptacle, and a piston disposed within the tube and forming a substantially fluid-tight seal with the tube. A reciprocating motion of the piston within the tube changes pressure of the molten metal mass, and an impulse force imparted by the piston on the molten metal mass within the receptacle causes a portion of the molten metal mass to eject through the aperture as a droplet. The droplet generator may also include a feed tube extending outward from the aperture; the piston abuts the first wall at an end of the reciprocating motion such that the piston closes off the aperture from the inside of the receptacle and forces a droplet of molten metal out of the feed tube. The droplet generator may be positioned such that the droplet is ejected in an upward trajectory.

The buffering chamber may include an enclosed volume having a height sufficient to allow the ejected droplet to reach a maximum unimpeded height in the upward trajectory. The buffering chamber may include an enclosed volume containing a gaseous medium, and a temperature control system that controls the temperature of the gaseous medium. The enclosed volume may include a bottom end having an opening for receiving the droplet as it descends after reaching the maximum unimpeded height in the upward trajectory.

The cooling drum may include a first cylinder, having an open top end and an open bottom end and surrounding a gaseous medium, a second cylinder, coaxial with the first cylinder and surrounding the first cylinder, and having a top end that is closed around the top end of the first cylinder, and a bottom end that is closed around the bottom end of the first cylinder, forming a reservoir between the first and second cylinders, and a system for controlling the temperature of the gaseous medium.

The system for controlling the temperature of the gaseous medium may include a first fluid inlet, disposed in an outer wall of the second cylinder, that receives a first fluid to be stored in the reservoir, and a second fluid inlet, disposed in the outer wall of the second cylinder, for receiving a second fluid to be dispersed within the first fluid in the reservoir. The system may also include a dispersal tube, connected to the second fluid inlet and surrounding the first cylinder within the reservoir, that receives the second fluid through the second fluid inlet, wherein the dispersal tube includes a plurality of holes through which the second fluid is dispersed within the first fluid. Preferably, the dispersal tube is a circular closed loop for receiving the second fluid from the second fluid inlet and for dispersing the second fluid into the first fluid, within the reservoir around the first cylinder, through the plurality of holes.

The apparatus may also include a gas screen disposed between the buffering chamber and the cooling drum, which provides temperature separation between respective media in the buffering chamber and the cooling drum. The gas screen may include a hollow disk having a top face with an opening for receiving the droplet from the buffering chamber, a bottom face with an opening for providing the droplet to the cooling drum, and circular outer wall connecting the top and bottom faces, and a fan, disposed within the hollow disk and positioned such that it blows a fluid medium within the hollow disk in a direction that is tangential to the outer wall.

The collector arrangement may include a reservoir that holds a liquid into which the metal sphere falls after passing through the cooling drum, a pipe, connected to a bottom end of the reservoir and in fluid communication with the reservoir, that receives the metal sphere and a volume of the liquid from the reservoir, and a delivery system that delivers the metal sphere to a collection basket. The reservoir may have lower sides that slope toward an opening in the pipe. The pipe may be an elbow joint having a bend in which the metal sphere settles. The delivery system may be a pump that pumps the metal sphere and the volume of the liquid to the collection basket, and the collection basket may be located at a level that is higher than a level of the liquid in the reservoir. The collector arrangement may include a holding tank in which the collection basket is disposed, and the collection basket has openings that are smaller than the metal sphere, through which the volume of liquid pass. The collector arrangement may include a return channel, in fluid communication between the holding tank and the reservoir, by which liquid passing through the openings in the collection basket is returned to the reservoir.

The cooling drum may be a plurality of cooling drums, including a first cooling drum, disposed to receive the droplet from the buffering chamber, and a last cooling drum, disposed to provide the metal sphere to the collector arrangement.

DETAILED DESCRIPTION OF THE INVENTION

Figure 7:
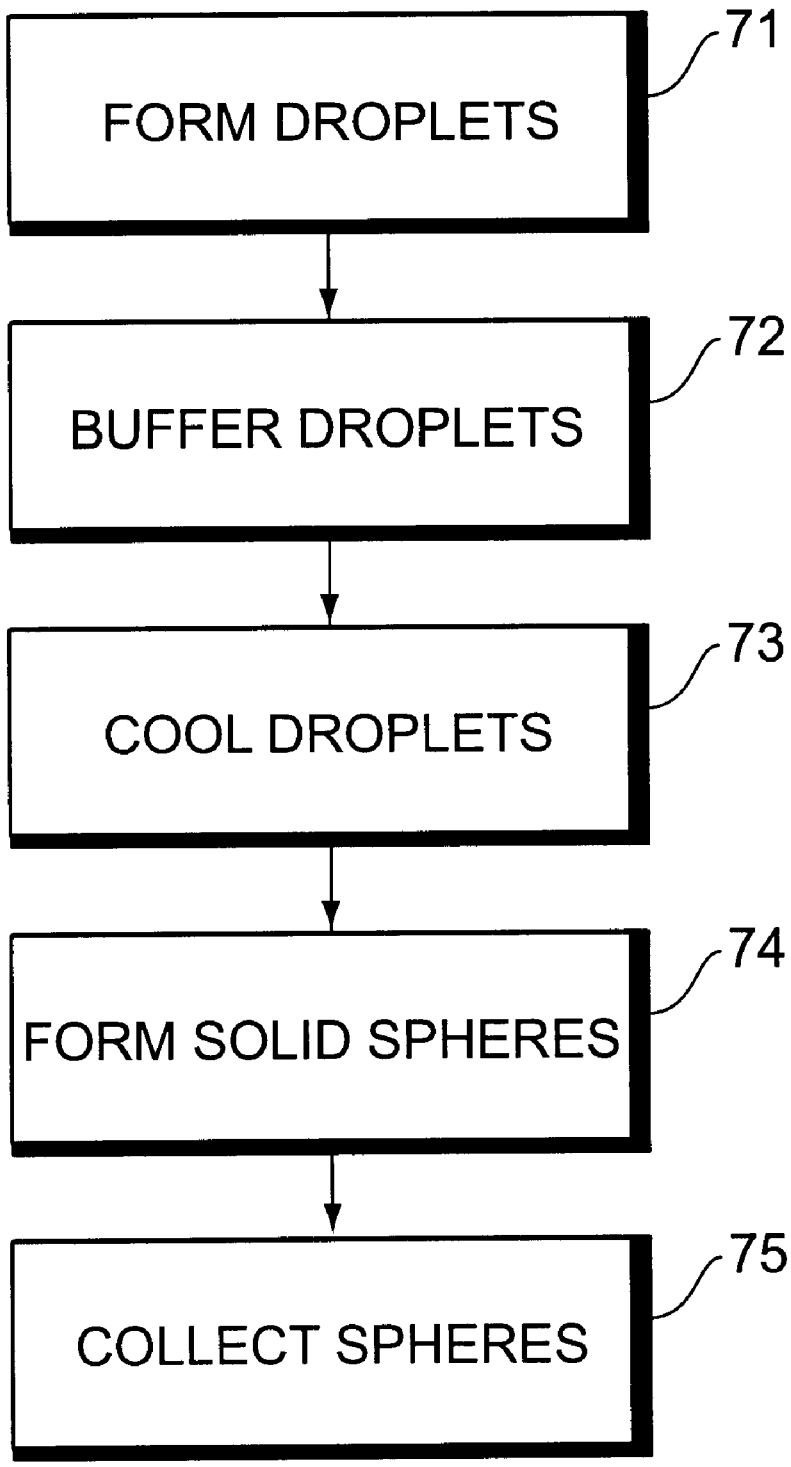
FIG. 7 is a flow diagram of the method of the present invention.

The present invention provides a process by which metal spheres can be fabricated. As shown in FIG. 7, the process begins with the formation of molten metal droplets 71. The droplets undergo a buffering action 72 to reduce the internal kinetic energy of the droplets prior to final cooling of the droplets to a solid form. Once the internal kinetic energy has been reduced a sufficient amount, the cooling process 73 can begin. Because the internal kinetic energy of the droplets has been reduced at this point, a droplet will form a spherical shape as it cools, due to the surface tension of the molten metal material. After cooling for a sufficient amount of time, the droplets become solid spheres 74, and are collected 75.

Figure 8:
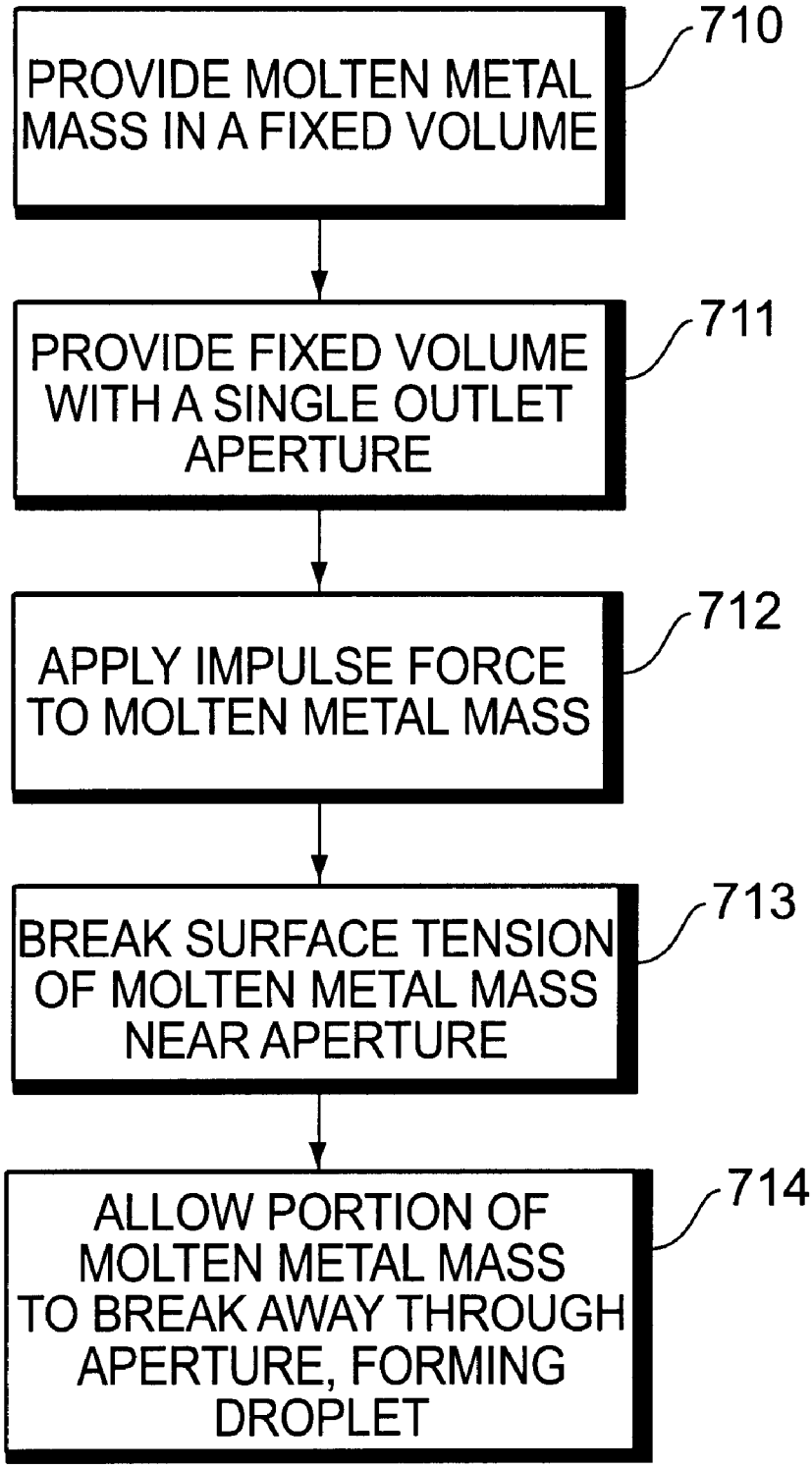
FIG. 8 is a flow diagram of the process of forming droplets of the present invention.

As shown in FIG. 8, the droplets are formed by providing a mass of molten metal, and exerting an impulse force to the mass of molten metal. The molten metal mass is constrained within a fixed volume 710, which is provided with a single outlet aperture 711. The impulse force that is applied to the molten metal mass 712 transmits through the molten metal mass. When this transmission of the impulse force reaches the surface of the molten metal mass near the aperture, the surface tension of the molten metal mass is broken there 713. Because the surface tension is broken, a portion of the metal mass breaks away and is forced out of the volume through the aperture, in the form of a droplet 714. The size of the droplet is determined by the size of the aperture, and the magnitude and duration of the impulse applied to the molten metal mass.

Figure 9:
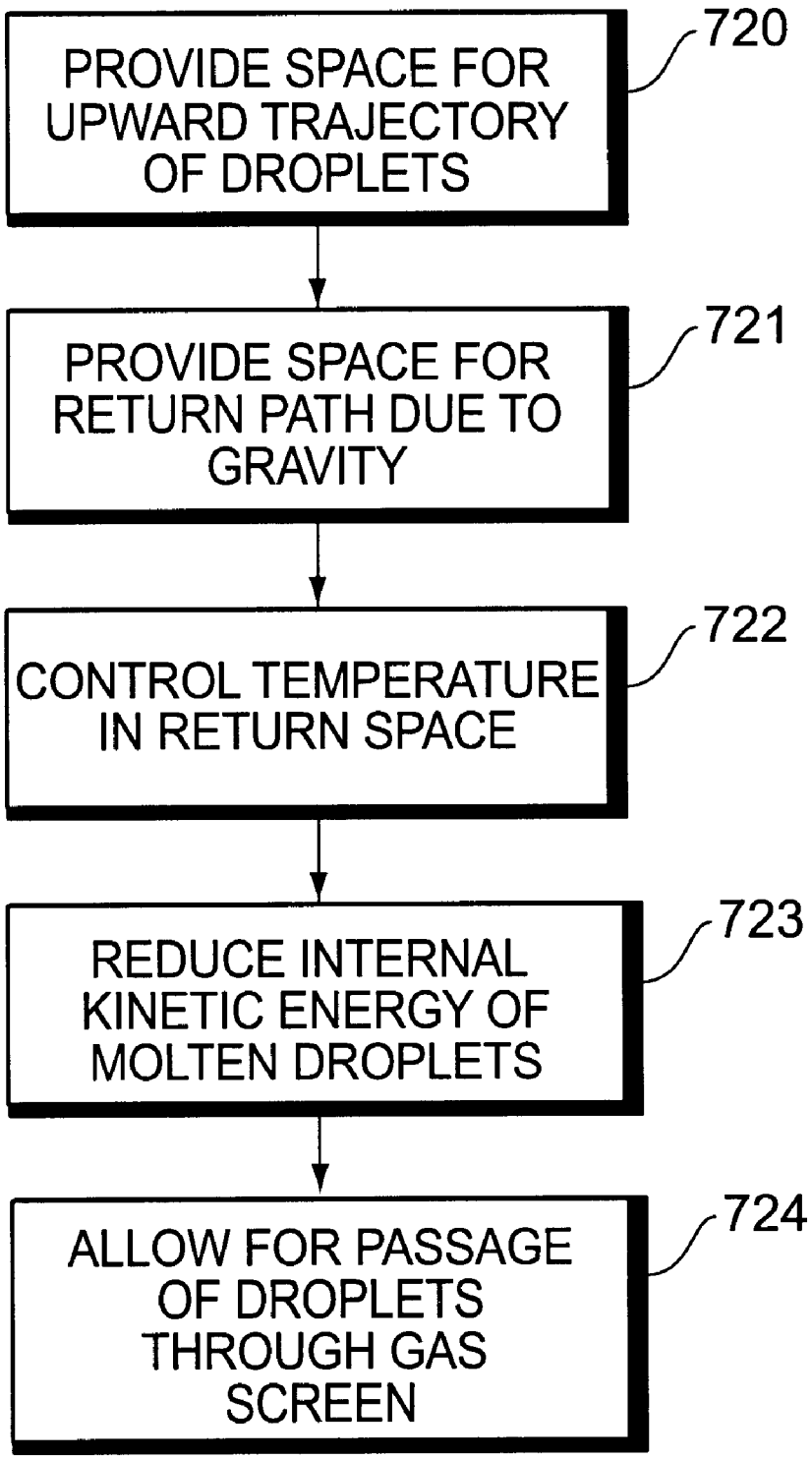
FIG. 9 is a flow diagram of the process of buffering the droplets of the present invention.
Figure 10:
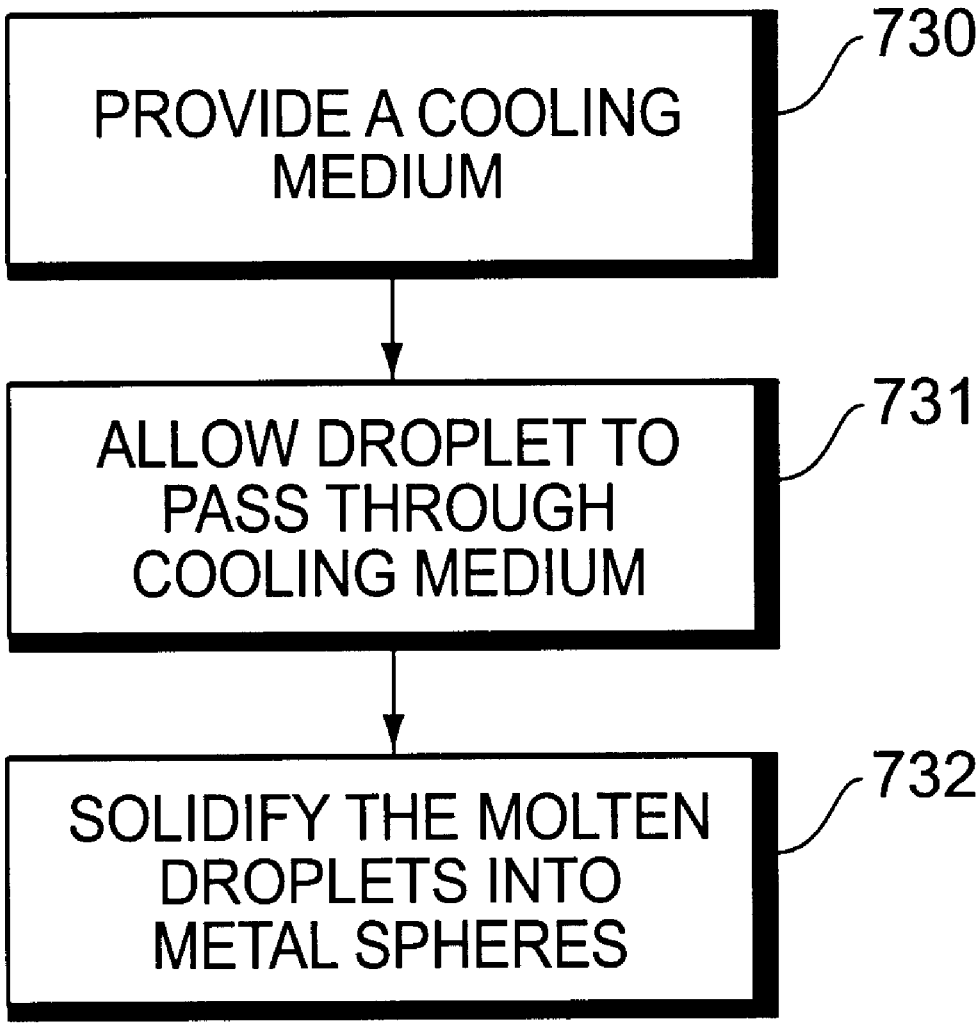
FIG. 10 is a flow diagram of the process of cooling the droplets of the present invention.
Figure 11:
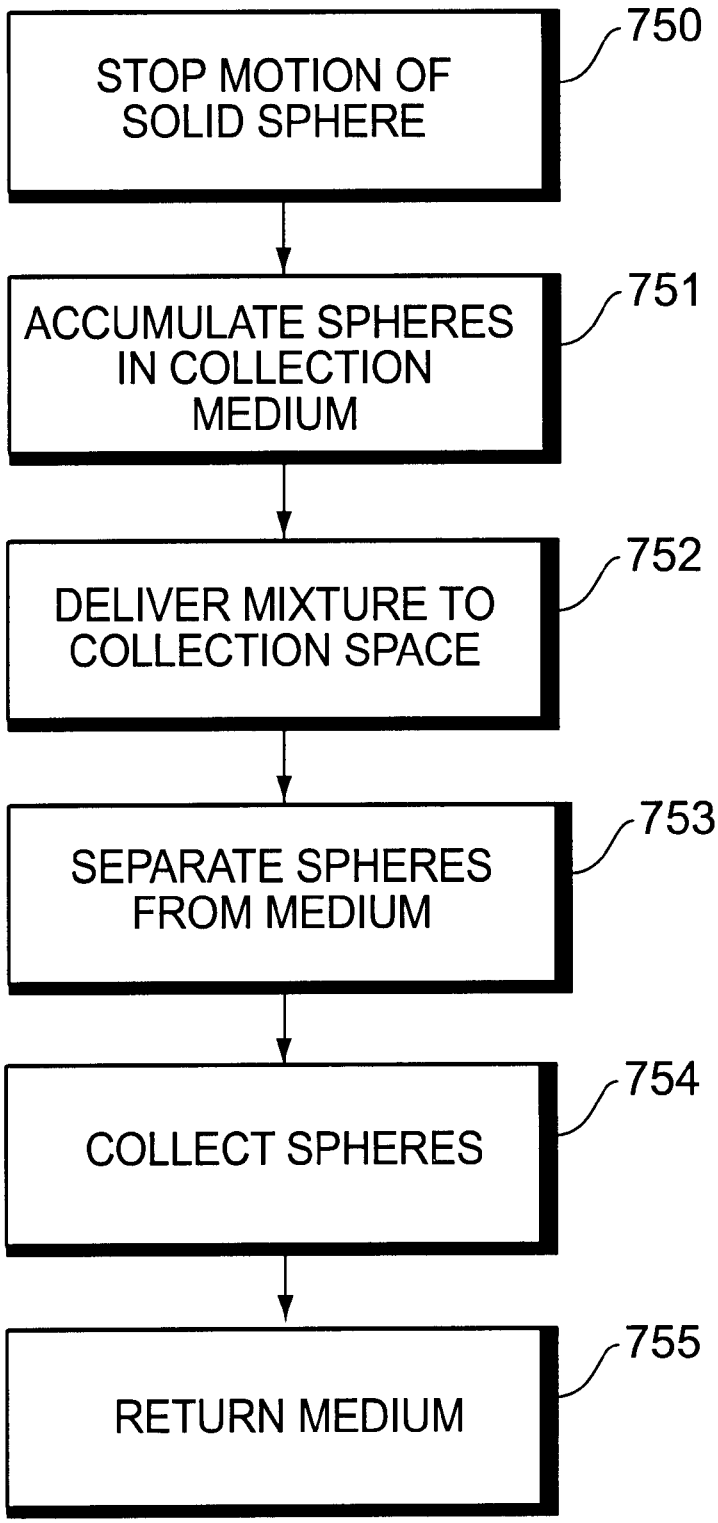
FIG. 11 is a flow diagram of the process of collecting the spheres of the present invention.

Once the droplet has been expelled through the aperture in this manner, its internal kinetic energy is high, and may even dominate the surface tension of the liquid droplet. Therefore, the buffering action takes place at this point, as shown in detail in FIG. 9. Buffering takes place by slowly cooling the droplets. This is accomplished by providing an environment wherein the temperature is kept in a range that will cool the droplets but not to the extent that they will quickly solidify. Assisting in this buffering process is the motion of the droplets. When the droplet is expelled through the aperture, the force experienced by the droplet ejects the droplet at great speed. Therefore, the path of the ejected droplet is directed generally upward. The droplet is allowed to travel through the buffering medium and gradually slow down in this generally upward trajectory until stopping at a maximum height due to the effects of gravity 720. The droplet then begins its descent due to gravity through the buffering space 721. As described above, the space in which the droplet descends has a temperature that is controlled 722. The droplet is allowed to fall under these controlled conditions until the internal kinetic energy of the droplets has sufficiently diminished 723, without causing the droplets to solidify. As described previously with reference to FIG. 7, the next process will be to cool the droplets further 73. Thus, part of the buffering process 72 preferably includes providing a gas screening action 724 between the buffering and cooling processes, to provide temperature separation as the droplets pass from the buffering stage 72 to the cooling stage 73. This may be effected by setting up a zone between the buffering medium and the cooling medium, whereby heat exchange between the two mediums is minimized.

The droplet is then cooled by providing a cooling medium 730 through which the falling droplet continues its descent 731. As the droplet falls through the cooling medium 731, it gradually changes from a molten, liquid state to a solid state, in the shape of a sphere 732. The time spent in the cooling medium must be sufficiently long to enable the spheres to harden completely. Because the droplets are falling as they cool, the length of cooling time is determined by the length of the path that the droplet is allowed to fall during the cooling process.

After the droplets have completely hardened and have become solid spheres, they must be collected. Further, because the droplets have been falling through a cooling medium during the cooling process, the motion of the falling spheres must be stopped 750. This is accomplished by allowing the spheres to plunge into a liquid bath at the termination of the cooling path. This liquid bath is a collection medium in which a number of metal spheres are accumulated 751. This mixture of spheres and medium is then delivered to a collection space 752, where the spheres are separated from the collection medium 753. The spheres can then be collected 754, and the collection medium preferably can be returned to the liquid bath 755. This is accomplished by pumping the liquid and sphere mixture from the bottom of the liquid bath up to a level above the level of the liquid bath. The liquid and sphere suspension is then drained such that the spheres are captured and the liquid is returned to the bath. The captured spheres may then be collected.

Figure 1:
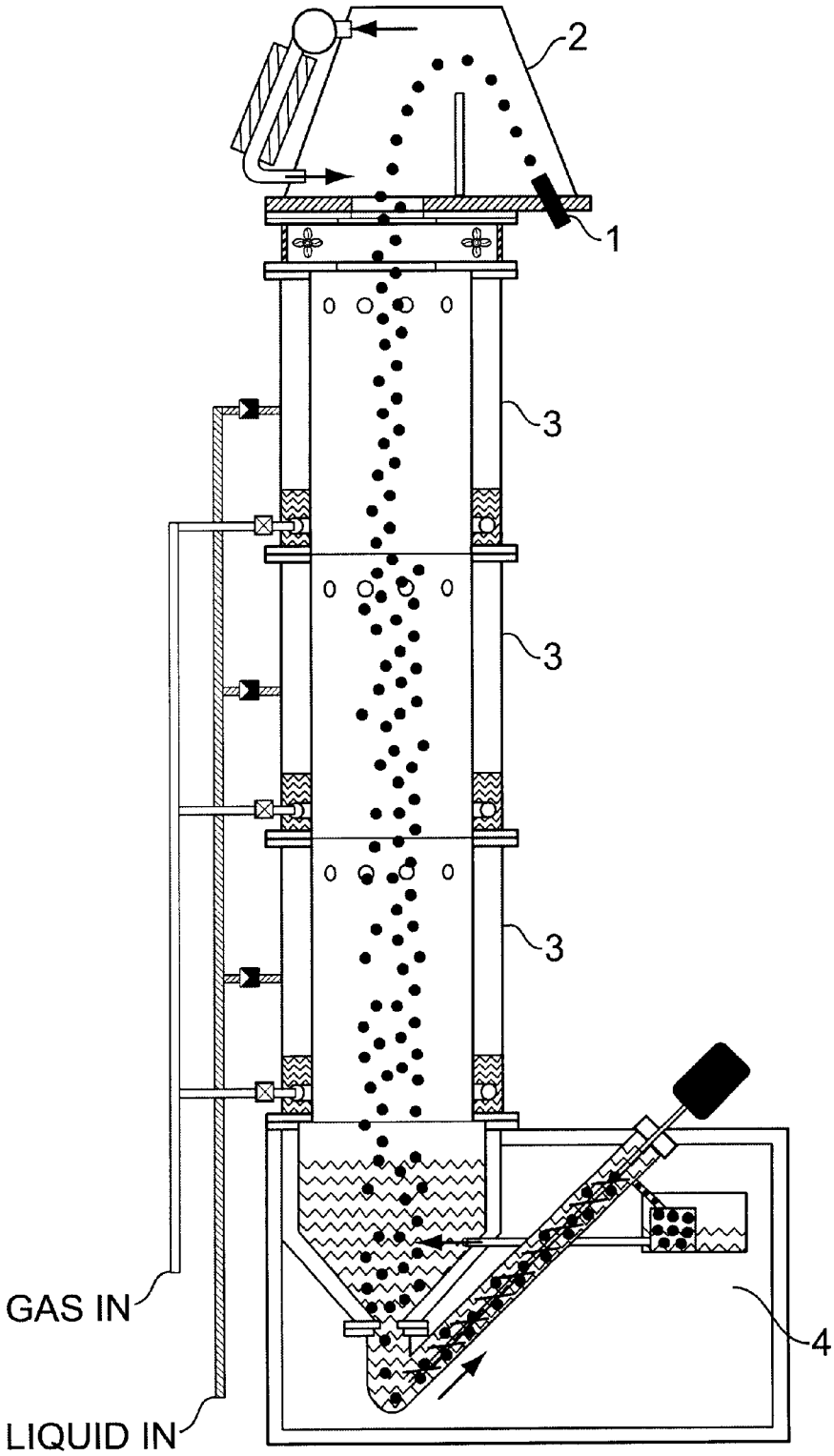
FIG. 1 shows a sectional diagram of an exemplary apparatus of the present invention.

FIG. 1 shows an overall view of the apparatus of the present invention. The structure of the invention can be divided into four major sections. The first section is the droplet generator 1, which produces the droplets that form the metal spheres. The second section is the buffering chamber 2, where the propelled droplets reach a peak height before beginning the fall toward the cooling drums, while dissipating internal kinetic energy under controlled temperature conditions. The third section is the cooling drum 3, a number of which may be provided and stacked in series as necessary. The solid metal spheres are formed as the droplets cool while passing through these drums. The fourth section is the collector 4, where the solid metal spheres end their descent and are gathered for collection.

Figure 2A:
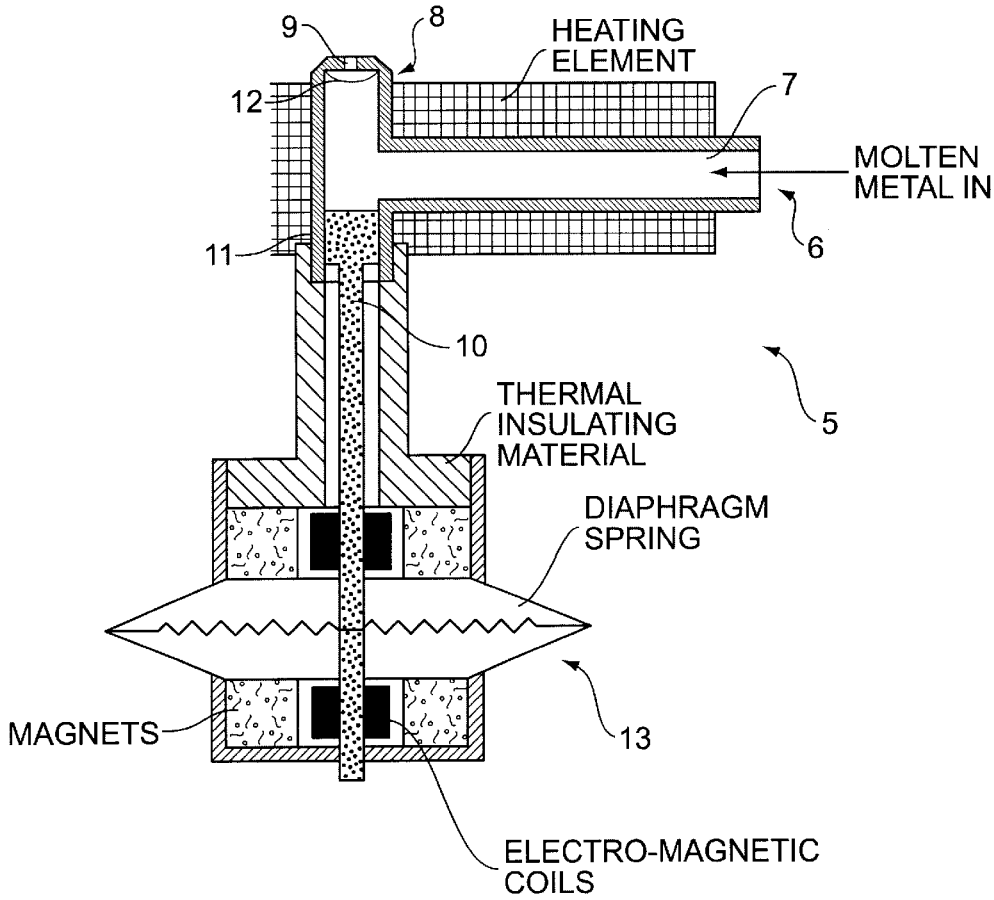
FIG. 2*a* shows a first embodiment of a molten metal droplet generator of the present invention.

FIG. 2*a* shows an exemplary droplet generator 5 according to the present invention. This embodiment of the droplet generator is particularly advantageous for producing droplets of any size larger than approximately 0.1 mm. The molten metal is provided to the inlet 6 of a T-shaped tube 7. The pressure of the liquid metal is controlled such that it is balanced with the surface tension of the molten metal at the top end 8 of the T-shaped tube 7. At this top end 8, there is a small hole that serves as a nozzle 9. A piston 10 is mounted opposite the nozzle 9 within the bottom end 11 of the T-shaped tube 7. The piston 10 provides a substantially airtight seal with the inner wall of the bottom end 11 of the T-shaped tube 7. When the piston moves up and down rapidly within the bottom end 11 of the T-shaped tube 7, it breaks the balance of forces between the surface tension and the pressure in the liquid metal. That is, the impact force of the piston on the molten metal within the T-shaped tube 7 is transmitted through the molten metal to the surface of the molten metal 12 at the top end 8 of the T-shaped tube 7. When this occurs, the internal pressure of the molten metal at the top end 8 exceeds the surface tension, allowing a portion of the molten metal to break away. Because the nozzle 9 is the only aperture through which this portion of the molten metal can escape, each up and down cycle of the piston motion generates a droplet of the molten metal pushed through the nozzle 9 as an output of the T-shaped tube 7. The motion of the piston 10 is preferably driven electronically, for example by an electro-mechanical transducer 13, such as a magnetic coil or piezo crystal, so that it can be controlled for uniform speed, distance of movement, and impact force.

Figure 2B:
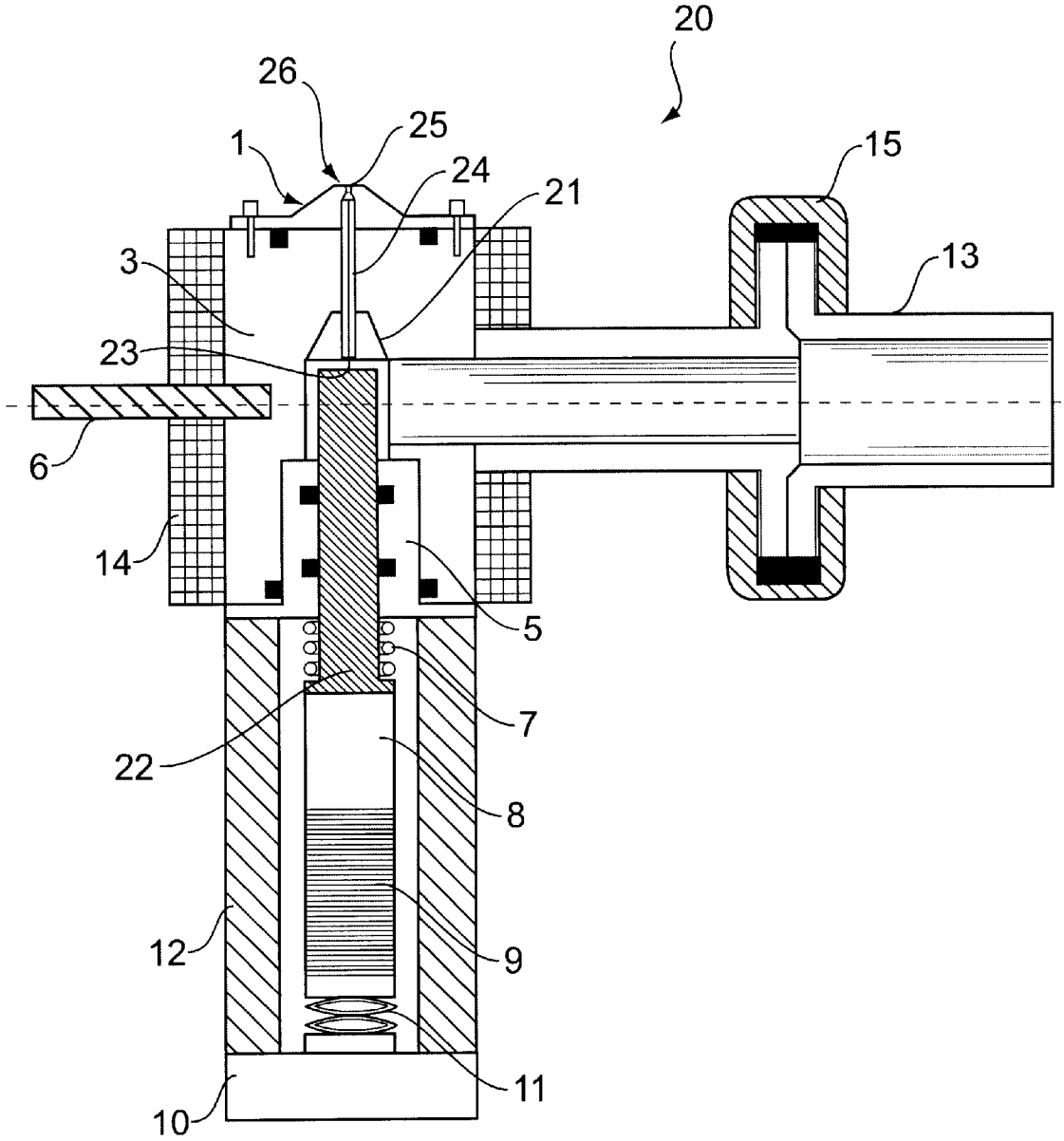
FIG. 2*b* shows a second embodiment of a molten metal droplet generator of the present invention.

FIG. 2*b* shows an alternative embodiment of the droplet generator 20 of the present invention. This embodiment is particularly advantageous for producing droplets of any size between approximately 0.10 mm and 2.50 mm. A stopper 21 is added at the front end of the reciprocating piston 22 motion. With each motion of the piston 22, there is a collision between the piston 22 and stopper 21, which closes off the proximate opening 23 in the nozzle feed tube 24 leading to the nozzle outlet 25 located at the distal end 26 of the nozzle feed tube 24, thereby forcing a droplet of molten metal out of the nozzle outlet 25. The piston displacement is very small and precise, and therefore causes an accurately measured amount of molten metal to be dispelled from the nozzle, which in turn becomes a droplet of predetermined size that forms a metal sphere having precisely controlled dimensions.

Figure 3:
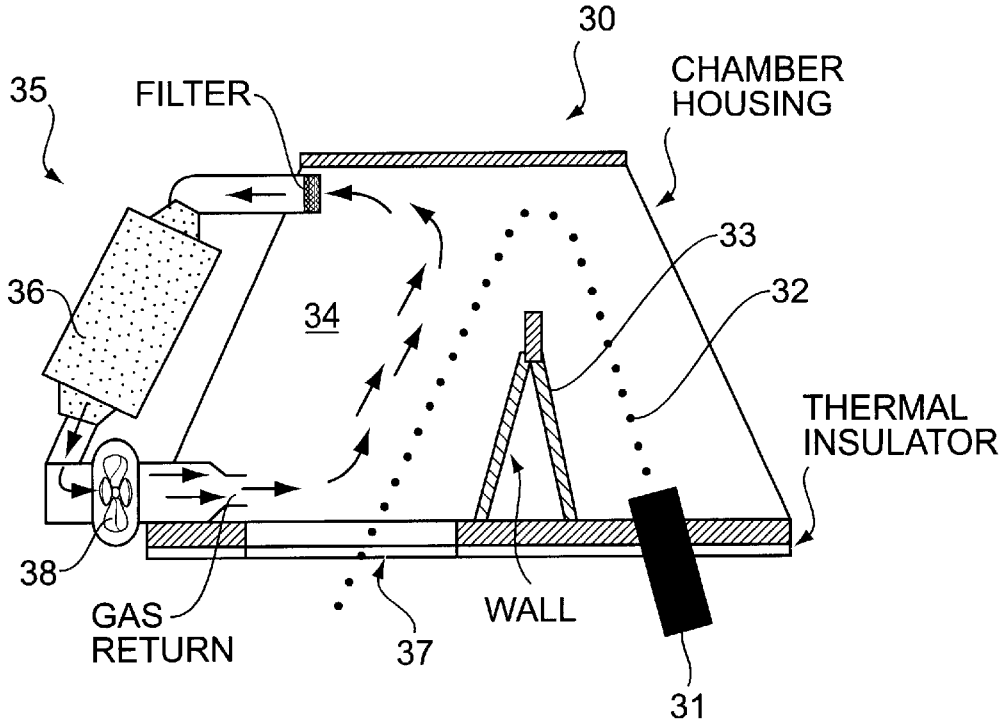
FIG. 3 shows an exemplary buffering chamber of the present invention.

FIG. 3 shows the structure of a buffering chamber 30 utilized to provide a space for the droplets to propel up and then fall back downward in a temperature-controlled environment. The droplet generator 31 dispels the droplets in an upward direction, such that they follow a path 32 over a dividing wall 33 before descending over the far side of the wall 33. In the area 34 of the chamber on the far side of the wall 33, there is an air circulation system 35 that includes a heat exchanger 36, which is used to control the temperature of the gas inside the area 34. A fan 38 draws air from the area 34 into the heat exchanger 36, where the temperature of the air is adjusted before being expelled back into the area 34. Usually, the temperature is kept between 25° C. and 100° C. As previously explained, the air temperature is kept at a level that allows the internal kinetic energy of the droplets in the area 34 to gradually dissipate, so that the droplets are better prepared for the cooling stage that will actually solidify the droplets. This buffering stage prevents the sudden, premature cooling and solidification that can result in approximate metal spheres having dimensions with unacceptably eccentric qualities.

Figure 4:
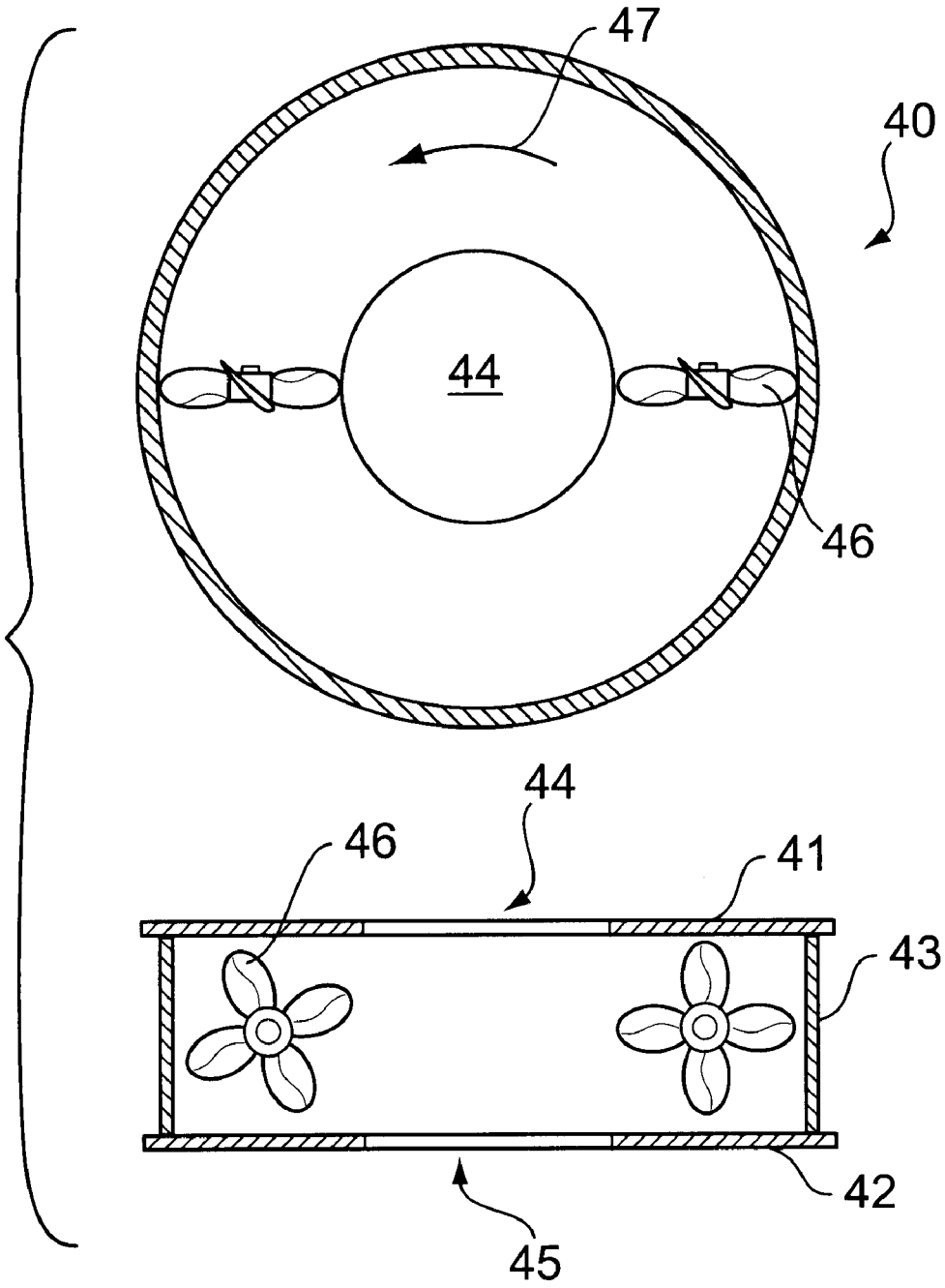
FIG. 4 shows an exemplary gas screen of the present invention.

As shown, the chamber 30 has an opening 37, preferably circular, at the bottom of the structure to allow the droplets drop through, leading to a gas screen. The gas screen 40, as shown in FIG. 4, is designed to provide temperature insulation between the relatively warm buffering chamber 30 and the colder drum below. The gas screen is a hollow circular disc structure having a top face 41 adjacent the buffering chamber 30, a bottom face 42 adjacent the cooling drum below, and a generally circular outer wall 43. The top and bottom faces of the disc each have an opening 44, 45, which is preferably circular in shape. One or more fans 46 are built inside the disc to direct the gas within the gas screen 40 such that it circulates 47 about the center axis of the disc. The circular motion of the air acts to prevent heat exchange between the air in the buffering chamber 30 above the gas screen and the cooling chamber disposed below the gas screen 40. The droplet, in its trajectory through the buffering chamber 30, passes through the opening 37 in the bottom of the buffering chamber 30, through the upper opening 44 in the gas screen 40, through the lower opening 45 in the gas screen 40, and into the cooling drum disposed below the gas screen 40.

Figure 5:
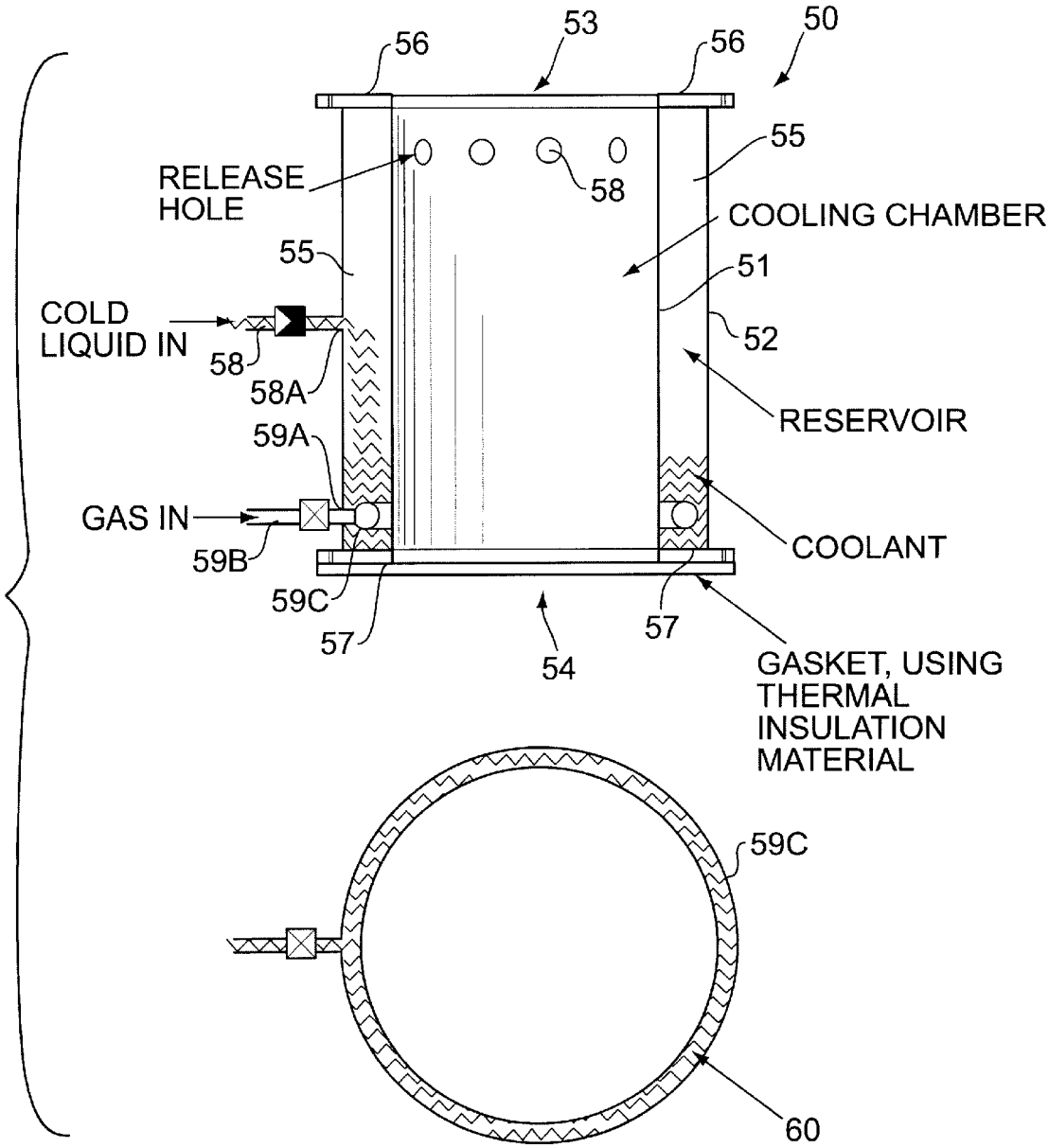
FIG. 5 shows an exemplary cooling drum of the present invention.

At least one such cooling drum 3 is located below the bottom face 42 of the gas screen 40, and the gas screen 40 may be disposed atop a stack of such cooling drums, as shown in FIG. 1. FIG. 5 shows the structure of an individual cooling drum 50 in the stack. The number of such cooling drums 50, if used in a stack, depends on the parameters of the particular cooling application. Such parameters include the size and material of the metal droplets, the impact of the droplet generator and attendant height reached by the propelled metal droplet, the amount of buffering time experienced by the metal droplet, and the height of each individual cooling drum 50.

Each cooling drum 50 includes two coaxial cylinders 51, 52. The inner cylinder 51 is hollow and has substantially open top 53 and bottom 54 ends, so that the droplets can pass through. The outer cylinder 52 also has a hollow interior, surrounding the inner cylinder 51, providing a chamber space 55 around the inner cylinder 51. This chamber space 55 is closed at top 56 and bottom 57 ends. The inner cylinder 51 also has at least one and preferably multiple holes 58 in the cylinder wall separating the inner 51 and outer 52 cylinders, toward the upper end of the inner cylinder 51. The outer cylinder 52 also has two inlet ports 58*a*, 59*a*, each connected to a respective feed pipe or tube 58*b*, 59*b*. The first inlet port and tube 58*a,b* are used to add a low temperature liquid, such as liquid nitrogen, to the chamber space 55 inside the outer cylinder 52 and outside the inner cylinder 51. The first inlet port 58*a* is located at height that allows the chamber space 55 to be filled sufficiently with the liquid, which acts as the coolant for the cooling drum. The second inlet port and tube 59*a,b* are used to provide a gas or gas mixture, such as 20% hydrogen in nitrogen, to a ring pipe 59*c* that is connected to the second inlet tube 59*b* and which encircles the inner cylinder 51 within the chamber space. The second inlet port 59*a*, second inlet tube 59*b*, and ring pipe 59*c* are located below the first inlet port 58*a*. Thus, when the chamber space 55 is sufficiently filled with the coolant liquid, the ring pipe 59*c* is submersed in the liquid. After the chamber space 55 is sufficiently filled with the coolant, preferably when the chamber space 55 is approximately half filled, gas is provided to the ring pipe 59*c* through the second inlet port 59*a*. The ring pipe 59*c* has a number of small gas release holes 60, through which gas in the ring pipe 59*c* is released into the coolant liquid in the chamber space 55. Thus, the temperature inside the cooling drum 50 is controlled by the temperature of the coolant liquid and also by the flow rate of the gas that blows through the liquid. In this manner, the temperature of the passage within the inner cylinder 51 can be maintained with a high degree of accuracy, so that a degree of control can be exercised over the solidification of the metal droplet passing through this passage. Quickly increasing the flow rate of the inlet gas can also provide rapid cooling of the passage, if necessary.

Figure 6:
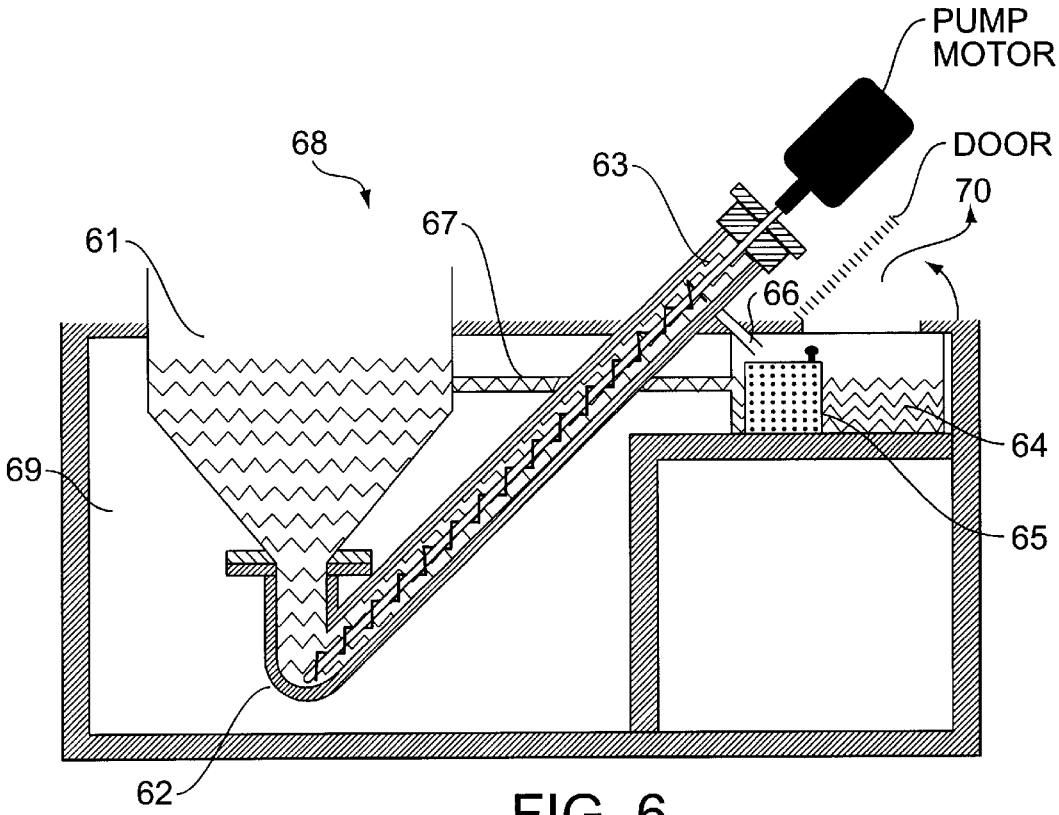
FIG. 6 shows an exemplary metal sphere collection system of the present invention.

Below the cooling drum 50, or below the bottom cooling drum 50 of the cooling tower, there is a sphere collecting arrangement 4, as shown in FIG. 1. This arrangement 68, as shown in detail in FIG. 6, includes a funnel-shaped reservoir 61, an elbow pipe or tube structure 62, a drum pump 63, and a collection tank 64. The reservoir 61 is located directly beneath the cooling drum 50 or tower, and contains a low freezing point liquid, such as Hexane. As a metal droplet falls from the top end of the first cooling drum to the bottom end of the last cooling drum, it solidifies into a spherical shape, and then plunges into the liquid in the reservoir 61. The solid metal balls then make their way down the slopes of the sides of the reservoir 61, and collect at the bottom of the elbow structure 62. The drum pump 63, which is connected to the other end of the elbow structure 62, pumps the liquid and metal sphere mixture up to the collection tank 64, such that all the metal spheres within the elbow structure 62 move with the liquid. A mesh basket 65, which is disposed inside the collection tank 64, receives the liquid and metal sphere mixture from the pump through a channel 66 or the like. The mesh basket 65 separates the solid spheres from the liquid. That is, the openings in the mesh walls of the basket 65 are smaller than the metal spheres, so that the liquid passes through the mesh walls of the basket 65, leaving only the metal spheres behind. The collection tank 64 is connected to the reservoir 61 by a pipe 67, through which the liquid flows back to the reservoir 61 after the metal spheres have been separated by the mesh basket 65. This is possible because the collection tank 64 is located at a point that is higher in elevation than the liquid level in the reservoir 61, so that the liquid naturally flows back to the reservoir 61, preventing waste of the reservoir liquid. Therefore, the drum pump 63 must be able to draw the liquid and metal sphere mixture up to the level of the collection tank 64. The entire sphere collecting arrangement 68 is preferably enclosed in a gas-tight cabinet 69 that has a closable opening 70 through which metal spheres that have accumulated in the mesh basket can be collected. Alternatively, the mesh basket 65 itself can be removed through the opening 70, and replaced with an empty mesh basket 65.

What is claimed is:

1. An apparatus for fabricating metal spheres, comprising:

a droplet generator that generates a droplet from a molten metal mass;

a buffering chamber that receives the droplet from the droplet generator, and diminishes internal kinetic energy of the droplet without solidifying the droplet; and a cooling drum that receives the droplet from the buffering chamber, and cools the droplet to the extent that the droplet solidifies into a metal sphere;

wherein the droplet generator includes a receptacle in which the molten metal mass is contained, wherein the receptacle includes a plurality of walls and a tube;

an aperture through a first wall of the plurality of walls of the receptacle; and a piston disposed within the tube and forming a substantially fluid-tight seal with the tube;

wherein reciprocating motion of the piston within the tube changes pressure of the molten metal mass.

2. The apparatus of claim 1, further comprising a collector arrangement that receives the metal sphere from the cooling drum and makes the metal sphere available for collection.

3. The apparatus of claim 2, wherein the collector arrangement includes a reservoir that holds a liquid into which the metal sphere falls after passing through the cooling drum;

a pipe, connected to a bottom end of the reservoir and in fluid communication with the reservoir, that receives the metal sphere and a volume of the liquid from the reservoir; and a delivery system that delivers the metal sphere to a collection basket.

4. The apparatus of claim 3, wherein the reservoir has lower sides that slope toward an opening in the pipe.

5. The apparatus of claim 3, wherein the pipe is an elbow joint having a bend in which the metal sphere settles.

6. The apparatus of claim 3, wherein the delivery system is a pump that pumps the metal sphere and the volume of the liquid to the collection basket; and the collection basket is located at a level that is higher than a level of the liquid in the reservoir.

7. The apparatus of claim 6, wherein the collector arrangement further includes a holding tank in which the collection basket is disposed; and the collection basket has opening that are smaller than the metal sphere, through which the volume of the liquid passes.

8. The apparatus of claim 7, wherein the collector arrangement includes a return channel, in fluid communication between the holding tank and the reservoir, by which liquid passing through the openings in the collection basket is returned to the reservoir.

9. The apparatus of claim 7, wherein the collection basket is removable from the holding tank.

10. The apparatus of claim 2, wherein the cooling drum is a plurality of cooling drums, including a first cooling drum, disposed to receive the droplet from the buffering chamber; and a last cooling drum, disposed to provide the metal sphere to the collector arrangement.

11. The apparatus of claim 1, wherein an impulse force imparted by the piston on the molten metal mass within the receptacle causes a portion of the molten metal mass to eject through the aperture as a droplet.

12. The apparatus of claim 11, wherein the droplet generator further includes a feed tube extending outward from the aperture; and the piston abuts the first wall at an end of the reciprocating motion such that the piston closes off the aperture from the inside of the receptacle and forces a droplet of molten metal out of the feed tube.

13. The apparatus of claim 11, wherein the droplet generator is positioned such that the droplet is ejected in an upward trajectory.

14. The apparatus of claim 13, wherein the buffering chamber includes an enclosed volume having a height sufficient to allow the ejected droplet to reach a maximum unimpeded height in the upward trajectory.

15. The apparatus of claim 14, wherein the enclosed volume includes a bottom end having an opening for receiving the droplet as it descends after reaching the maximum unimpeded height in the upward trajectory.

16. The apparatus of claim 1, wherein the buffering chamber includes an enclosed volume containing a gaseous medium; and a temperature control system that controls the temperature of the gaseous medium.

17. An apparatus for fabricating metal spheres, comprising:

a droplet generator that generates a droplet from a molten metal mass;

a buffering chamber that receives the droplet from the droplet generator, and diminishes internal kinetic energy of the droplet without solidifying the droplet; and a cooling drum that receives the droplet from the buffering chamber, and cools the droplet to the extent that the droplet solidifies into a metal sphere;

wherein the cooling drum includes a first cylinder, having an open top end and an open bottom end and surrounding a gaseous medium;

a second cylinder, coaxial with the first cylinder and surrounding the first cylinder, and having a top end that is closed around the top end of the first cylinder, and a bottom end that is closed around the bottom end of the first cylinder, forming a reservoir between the first and second cylinders; and a system for controlling the temperature of the gaseous medium.

18. The apparatus of claim 17, wherein the system for controlling the temperature of the gaseous medium includes a first fluid inlet, disposed in an outer wall of the second cylinder, that receives a first fluid to be stored in the reservoir.

19. The apparatus of claim 18, wherein the system for controlling the temperature of the gaseous medium includes a second fluid inlet, disposed in the outer wall of the second cylinder, for receiving a second fluid to be dispersed within the first fluid in the reservoir.

20. The apparatus of claim 19, wherein the system for controlling the temperature of the gaseous medium includes a dispersal tube, connected to the second fluid inlet and surrounding the first cylinder within the reservoir, that receives the second fluid through the second fluid inlet, wherein the dispersal tube includes a plurality of holes through which the second fluid is dispersed within the first fluid.

21. The apparatus of claim 20, wherein the dispersal tube is a circular closed loop for receiving the second fluid from the second fluid inlet and for dispersing the second fluid into the first fluid, within the reservoir around the first cylinder, through the plurality of holes.

22. The apparatus of claim 17, further comprising a collector arrangement that receives the metal sphere from the cooling drum and makes the metal sphere available for collection.

23. The apparatus of claim 22, wherein the collector arrangement includes a reservoir that holds a liquid into which the metal sphere falls after passing through the cooling drum;

a pipe, connected to a bottom end of the reservoir and in fluid communication with the reservoir, that receives the metal sphere and a volume of the liquid from the reservoir; and a delivery system that delivers the metal sphere to a collection basket.

24. The apparatus of claim 23, wherein the reservoir has lower sides that slope toward an opening in the pipe.

25. The apparatus of claim 23, wherein the pipe is an elbow joint having a bend in which the metal sphere settles.

26. The apparatus of claim 23, wherein the delivery system is a pump that pumps the metal sphere and the volume of the liquid to the collection basket; and the collection basket is located at a basket level that is higher than a level of the liquid in the reservoir.

27. The apparatus of claim 26, wherein the collector arrangement further includes a holding tank in which the collection basket is disposed; and the collection basket has openings that are smaller than the metal sphere, through which the volume of the liquid passes.

28. The apparatus of claim 27, wherein the collector arrangement includes a return channel, in fluid communication between the holding tank and the reservoir, by which liquid passing through the openings in the collection basket is returned to the reservoir.

29. The apparatus of claim 27, wherein the collection basket is removable from the holding tank.

30. The apparatus of claim 22, wherein the cooling-drum is a plurality of cooling drums, including a first cooling drum, disposed to receive the droplet from the buffering chamber; and a last cooling drum, disposed to provide the metal sphere to the collector arrangement.

31. The apparatus of claim 17, wherein the buffering chamber includes an enclosed volume containing a gaseous medium; and a temperature control system that controls the temperature of the gaseous medium.

32. An apparatus for fabricating metal spheres, comprising:

a droplet generator that generates a droplet from a molten metal mass;

a buffering chamber that receives the droplet from the droplet generator, and diminishes internal kinetic energy of the droplet without solidifying the droplet;

a cooling drum that receives the droplet from the buffering chamber, and cools the droplet to the extent that the droplet solidifies into a metal sphere; and a gas screen disposed between the buffering chamber and the cooling drum, which provides temperature separation between respective media in the buffering chamber and the cooling drum;

wherein the gas screen includes a hollow disk having a top face with an opening for receiving the droplet from the buffering chamber, a bottom face with an opening for providing the droplet to the cooling drum, and a circular outer wall connecting the top and bottom faces; and a fan, disposed within the hollow disk and positioned such that it blows a fluid medium within the hollow disk in a direction that is tangential to the outer wall.

33. The apparatus of claim 32, further comprising a collector arrangement that receives the metal sphere from the cooling drum and makes the metal sphere available for collection.

34. The apparatus of claim 33, wherein the collector arrangement includes a reservoir that holds a liquid into which the metal sphere falls after passing through the cooling drum;

a pipe, connected to a bottom end of the reservoir and in fluid communication with the reservoir, that receives the metal sphere and a volume of the liquid from the reservoir; and a delivery system that delivers the metal sphere to a collection basket.

35. The apparatus of claim 34, wherein the reservoir has lower sides that slope toward an opening in the pipe.

36. The apparatus of claim 34, wherein the pipe is an elbow joint having a bend in which the metal sphere settles.

37. The apparatus of claim 34, wherein the delivery system is a pump that pumps the metal sphere and the volume of the liquid to the collection basket; and the collection basket is located at a basket level that is higher than a level of the liquid in the reservoir.

38. The apparatus of claim 37, wherein the collector arrangement further includes a holding tank in which the collection basket is disposed; and the collection basket has openings that are smaller than the metal sphere, through which the volume of the liquid passes.

39. The apparatus of claim 38, wherein the collector arrangement includes a return channel, in fluid communication between the holding tank and the reservoir, by which liquid passing through the openings in the collection basket is returned to the reservoir.

40. The apparatus of claim 38, wherein the collection basket is removable from the holding tank.

41. The apparatus of claim 33, wherein the cooling drum is a plurality of cooling drums, including a first cooling drum, disposed to receive the droplet from the buffering chamber; and a last cooling drum, disposed to provide the metal sphere to the collector arrangement.

42. The apparatus of claim 32, wherein the buffering chamber includes an enclosed volume containing a gaseous medium; and a temperature control system that controls the temperature of the gaseous medium.

43. An apparatus for fabricating metal spheres, comprising:

a droplet generator that generates a droplet from a molten metal mass;

a buffering chamber that receives the droplet from the droplet generator, and diminishes internal kinetic energy of the droplet without solidifying the droplet;

a cooling drum, including an enclosure having an opening, that receives the droplet from the buffering chamber through the opening, and cools the droplet to the extent that the droplet solidifies into a metal sphere; and a gas screen disposed between the buffering chamber and the cooling drum, wherein the gas screen includes a hollow disk having a top face with an opening for receiving the droplet from the buffering chamber, a bottom face with an opening for providing the droplet to the cooling drum, and a circular outer wall connecting the top face and the bottom face, and a fan, disposed within the hollow disk, and positioned such that the fan blows a fluid medium within the hollow disk in a direction that is tangential to the outer wall;

wherein the movement of the fluid medium provides temperature separation between a medium in the buffering chamber and a medium in the cooling drum.

44. The apparatus of claim 43, wherein the medium in the buffering chamber is warmer than the medium in the cooling drum.

45. The apparatus of claim 43, wherein, the buffering chamber is a disposed above the cooling drum.

46. The apparatus of claim 46, further comprising:

a collector arrangement that receives the metal sphere from the cooling drum and makes the metal sphere available for collection;

wherein the cooling drum is a plurality of cooling drums, including a first cooling drum, disposed beneath the buffering chamber to receive the droplet from the buffering chamber, and a last cooling drum, disposed below the first cooling drum, to provide the metal sphere to the collector arrangement.

47. An apparatus for fabricating metal spheres, comprising:

a droplet generator that generates a droplet from a molten metal mass;

a buffering chamber that receives the droplet from the droplet generator, and diminishes internal kinetic energy of the droplet without solidifying the droplet; and a cooling drum, including an enclosure having an opening, that receives the droplet from the buffering chamber through the opening, and cools the droplet to the extent that the droplet solidifies into a metal sphere;

wherein the droplet generator includes a receptacle in which the molten metal mass is contained, wherein the receptacle includes a plurality of walls and a piston tube, an aperture through a first wall of the plurality of walls of the receptacle, a piston disposed within the piston tube and forming a substantially fluid-tight seal with the piston tube, and a feed tube extending outward from the aperture, wherein reciprocating motion of the piston within the piston tube changes pressure of the molten metal mass, and the piston abuts the first wall at an end of the reciprocating motion such that the piston closes off the aperture from the inside of the receptacle, and a resulting impulse force imparted on the molten metal mass causes a portion of the molten metal mass to eject through the aperture as the droplet.

48. The apparatus of claim 47, wherein the buffering chamber is disposed above the cooling drum.

49. The apparatus of claim 48, further comprising:

a collector arrangement that receives the metal sphere from the cooling drum and makes the metal sphere available for collection;

wherein the cooling drum is a plurality of cooling drums, including a first cooling drum, disposed beneath the buffering chamber to receive the droplet from the buffering chamber, and a last cooling drum, disposed below the first cooling drum, to provide the metal sphere to the collector arrangement.

50. An apparatus for fabricating metal spheres, comprising:

a droplet generator that generates a droplet from a molten metal mass;

a buffering chamber that receives the droplet from the droplet generator, and diminishes internal kinetic energy of the droplet without solidifying the droplet; and a cooling drum, including an enclosure having an opening, that receives the droplet from the buffering chamber through the opening, and cools the droplet to the extent that the droplet solidifies into a metal sphere;

wherein the cooling drum includes a first cylinder, having an open top end and an open bottom end and surrounding a gaseous medium, a second cylinder, coaxial with the first cylinder and surrounding the first cylinder, and having a top end that is closed around the top end of the first cylinder, and a bottom end that is closed around the bottom end of the first cylinder, forming a reservoir between the first cylinder and the second cylinder, a first fluid inlet, disposed in an outer wall of the second cylinder, that receives a first fluid to be stored in the reservoir, a second fluid inlet, disposed in an outer wall of the second cylinder, that receives a second fluid to be dispersed within the first fluid in the reservoir, and a dispersal tube, connected to the second fluid inlet and surrounding the first cylinder within the reservoir, that receives the second fluid through the second fluid inlet, wherein the dispersal-tube includes a plurality of holes through which the second fluid is dispersed within the first fluid.

51. The apparatus of claim 50, wherein the first fluid is a liquid, and the second fluid is a gas.

52. The apparatus of claim 50, wherein the first fluid is liquid nitrogen.

53. The apparatus of claim 50, wherein the second fluid is a gas mixture of hydrogen in nitrogen.

54. The apparatus of claim 50, wherein the buffering chamber is disposed above the cooling drum.

55. The apparatus of claim 54, further comprising:

a collector arrangement that receives the metal sphere from the cooling drum and makes the metal sphere available for collection;

wherein the cooling drum is a plurality of cooling drums, including a first cooling drum, disposed beneath the buffering chamber to receive the droplet from the buffering chamber, and a last cooling drum, disposed below the first cooling drum, to provide the metal, sphere to the collector arrangement.

56. An apparatus for fabricating metal spheres, comprising:

a droplet generator that generates a droplet from a molten metal mass;

a buffering chamber that receives the droplet from the droplet generator, and diminishes internal kinetic energy of the droplet without solidifying the droplet; and a cooling drum that receives the droplet from the buffering chamber, and cools the droplet to the extent that the droplet solidifies into a metal sphere;

wherein the droplet generator ejects the droplet at an upward angle, such that the droplet follows a trajectory that proceeds upward until the droplet reaches a maximum height before descending; and wherein the buffering chamber includes a circulation system that provides a generally upward flow of gas within the buffering chamber that slows a rate of descent of the droplet as the droplet is descending.

57. The apparatus of claim 56, wherein the air circulation system includes a fan to provide the generally upward flow of gas, and a heat exchanger to control the temperature of the gas.

58. The apparatus of claim 56, further comprising a collector arrangement that receives the metal sphere from the cooling drum and makes the metal sphere available for collection.

59. The apparatus of claims 56, wherein the collector arrangement includes a reservoir that holds a liquid into which the metal sphere falls after passing through the cooling drum;

a pipe, connected to a bottom end of the reservoir and in fluid communication with the reservoir, that receives the metal sphere and a volume of the liquid from the reservoir; and a delivery system that delivers the metal sphere to a collection basket.

60. The apparatus of claim 59, wherein the reservoir has lower sides that slope toward an opening in the pipe.

61. The apparatus of claim 59, wherein the pipe is an elbow joint having a bend in which the metal sphere settles.

62. The apparatus of claim 59, wherein the delivery system is a pump that pumps the metal sphere and the volume of the liquid to the collection basket; and the collection basket is located at a basket level that is higher than a level of the liquid in the reservoir.

63. The apparatus of claim 62, wherein the collector arrangement further includes a holding tank in which the collection basket is disposed; and the collection basket has openings that are smaller than the metal sphere, through which the volume of the liquid passes.

64. The apparatus of claim 63, wherein the collector arrangement includes a return channel, in fluid communication between the holding tank and the reservoir, by which liquid passing through the openings in the collection basket is returned to the reservoir.

65. The apparatus of claim 63, wherein the collection basket is removable from the holding tank.

66. The apparatus of claim 56, wherein the cooling drum is a plurality of cooling drums, including a first cooling drum, disposed to receive the droplet from the buffering chamber; and a last cooling drum, disposed to provide the metal sphere to the collector arrangement.

67. The apparatus of claim 56, wherein the buffering chamber includes an enclosed volume containing a gaseous medium; and a temperature control system that controls the temperature of the gaseous, medium.

* * * * *